US008580407B2

(12) United States Patent
Okuhira

(10) Patent No.: US 8,580,407 B2
(45) Date of Patent: Nov. 12, 2013

(54) COVERING MEMBER FOR PREVENTING EROSION

(75) Inventor: Hiroyuki Okuhira, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 275 days.

(21) Appl. No.: 13/203,897

(22) PCT Filed: Mar. 1, 2010

(86) PCT No.: PCT/JP2010/053710
§ 371 (c)(1),
(2), (4) Date: Aug. 30, 2011

(87) PCT Pub. No.: WO2010/106929
PCT Pub. Date: Sep. 23, 2010

(65) Prior Publication Data

US 2011/0311837 A1 Dec. 22, 2011

(30) Foreign Application Priority Data

Mar. 17, 2009 (JP) ..... 2009-064415

(51) Int. Cl.
*B22C 9/06* (2006.01)

(52) U.S. Cl.
USPC ..... 428/697; 428/336; 428/469; 428/472; 428/698; 428/699

(58) Field of Classification Search
USPC ..... 428/336, 469, 472, 697, 698, 699
See application file for complete search history.

(56) References Cited

U.S. PATENT DOCUMENTS

| | | | | |
|---|---|---|---|---|
| 5,423,923 | A * | 6/1995 | Yamagata et al. | 148/421 |
| 7,060,345 | B2 * | 6/2006 | Fukui et al. | 428/216 |
| 7,592,076 | B2 * | 9/2009 | Flink et al. | 428/698 |
| 7,923,130 | B2 * | 4/2011 | Shibata et al. | 428/697 |
| 8,075,744 | B1 * | 12/2011 | Johansson et al. | 204/192.16 |

FOREIGN PATENT DOCUMENTS

| | | | |
|---|---|---|---|
| JP | 08-118106 | * | 5/1996 |
| JP | 2000-334606 | * | 12/2000 |
| JP | 2006 138008 | | 6/2006 |
| JP | 2007-136655 | * | 6/2007 |
| JP | 2008 093760 | | 4/2008 |
| WO | 2008 146727 | | 12/2008 |

OTHER PUBLICATIONS

Yang et al "Microstructure characterization of multilayered TiSiN/CrN thin films" Jouranl of Nanoscience & nanotechnology vol. 8 2008 p. 2688-2692.*

(Continued)

*Primary Examiner* — Archene Turner
(74) *Attorney, Agent, or Firm* — Oblon, Spivak, McClelland, Maier & Neustadt, L.L.P.

(57) ABSTRACT

There is provided a covering member for preventing erosion that has a high erosion resistance, is resistant to repeated thermal shocks so as to have a long life, and has a particular color allowing visual inspection of the surface layer for degradation.

A covering member to be applied to a substrate made of an iron material or the like that will be eroded by contact with molten aluminum includes a Cr metal film as the lowest layer, a b layer formed of a CrN film, an intermediate layer, and an a layer formed of a TiSiN film, stacked in this order on the substrate. The intermediate layer includes layered films composed of the b layers and the a layers alternately stacked on top of one another.

7 Claims, 5 Drawing Sheets

(56) References Cited

OTHER PUBLICATIONS

Yang, S.-M., et al., "Mechanical and tribological properties of multilayered TiSiN/CrN coatings synthesized by a cathodic arc deposition process," Surface & Coatings Technology, vol. 202, pp. 2176-2181, (2008).

International Search Report issued Apr. 6, 2010 in PCT/JP10/053710 filed Mar. 1, 2010.

* cited by examiner

COVERING MEMBER FOR PREVENTING EROSION

TECHNICAL FIELD

The present invention relates to a covering member for preventing erosion, which can prevent the erosion of iron substrates and other substrates caused by contact with molten aluminum.

BACKGROUND ART

Iron materials have a problem of reacting with molten aluminum to form iron-aluminum alloys, that is, dissolving (being eroded) in molten aluminum.

The problem of erosion also occurs in mechanical components, metal molds, cutting tools, and other tools made of iron materials, including stainless, titanium materials, and superhard materials when they are in contact with molten aluminum.

In order to prevent the erosion, it is considered as a simple and effective means to cover the surface of a substrate made of an iron material or the like to be eroded with a covering member for preventing erosion. In this case, the covering member for preventing erosion should basically have erosion resistance. Since the covering member is usually abruptly brought into contact with molten aluminum, the covering member should also have thermal shock resistance. Furthermore, since the covering material must be visually inspected for degradation, it is necessary for the surface layer to be of a particular color that allows the visual inspection for degradation rather than a common metallic color.

Although various ceramic materials for use in covering members for preventing erosion have a high heat resistance and generally a high erosion resistance, they are brittle and are highly likely to be broken by thermal shock. In the case that the surface of a substrate made of an iron material or the like is coated with a ceramic material, gold-colored titanium nitride (TiN) is advantageous in the visual inspection for degradation but has an insufficient erosion resistance.

Chromium nitride (CrN) having a high erosion resistance [see PTL 1] cannot be visually inspected for degradation because of its metallic color. Titanium silicon nitride (TiSiN) facilitates visual inspection for degradation because of its orange to violet color and is expected to have a higher erosion resistance because of its higher heat resistance than CrN. However, titanium silicon nitride is prone to be broken by thermal shock because of its high hardness.

PRIOR ART DOCUMENTS

Patent Literature

PTL 1: Japanese Unexamined Patent Application Publication No. 8-209331

SUMMARY OF THE INVENTION

Problems to be Solved by the Invention

A technical task of the present invention is to provide a covering member for preventing erosion that basically has a high erosion resistance, is resistant to repeated thermal shocks so as to have a long life, and has a particular color that allows visual inspection of the surface layer for degradation.

Means for Solving the Problems

In order to achieve the task, the present invention provides a covering member to be applied to a substrate that will be eroded by contact with molten aluminum. The covering member includes the lowest layer, a b layer, an intermediate layer, and an a layer to be stacked in this order on the substrate, wherein the lowest layer is a Cr metal film, the b layer is a CrN film, and the top a layer is a TiSiN film, and the intermediate layer includes layered films composed of the TiSiN films of the a layer and the CrN films of the b layer alternately stacked on top of one another such that films of the same type do not overlap.

In preferred embodiments of a covering member for preventing erosion according to the present invention, the substrate is made of an iron material, including stainless, a titanium material, or a superhard material, the metal components of the TiSiN film of the a layer desirably has a Ti:Si ratio in the range of 90:10 to 50:50 (% by atom), the intermediate layer includes two or more alternately stacked a and b layers in total, and each of the lowest layer, the b layer, and the a layer is a monolayer, and the thickness of the intermediate layer and the a and b layers disposed on the intermediate layer desirably ranges from 2 to 10 μm. Each of the films can be formed by a common deposition method, such as a physical vapor deposition method (PVD method) or a plasma chemical vapor deposition method (P-CVD method).

A covering member for preventing erosion according to the present invention having the structure described above is formed of a multilayer film made of CrN having a high erosion resistance and TiSiN having a higher heat resistance than CrN. These materials themselves have a high erosion resistance. Furthermore, the CrN film of the b layer having a low hardness is applied to the substrate through the Cr metal film, TiSiN of the a layer having a high hardness and a high heat resistance is disposed as the top layer, and, as the intermediate layer, the CrN films and the TiSiN films are alternately stacked on top of one another such that films of the same type do not overlap. This produces a hardness distribution between the substrate and the outer surface of the covering member. This can relieve a stress applied to the outer surface, improve the adhesion of the covering member, and prevent breakage caused by thermal shock even though the top layer is made of hard TiSiN.

The Cr metal film (the lowest layer) disposed between the substrate and the b layer of the CrN film allows Cr ions to diffuse in the substrate, thereby improving the adhesion of the covering member. A covering member for preventing erosion having a thickness in the range of 2 to 10 μM can be resistant to breakage caused by thermal shock while retaining a high erosion resistance.

The covering member for preventing erosion includes the top layer made of hard TiSiN. Unlike the CrN film, which has a metallic color that makes it difficult to inspect the covering member for degradation, TiSiN having an orange to violet color effectively facilitates the inspection of the covering member for degradation. In particular, TiSiN of the top layer has a high erosion resistance when the Si content ranges from 20 to 30 (% by atom). Although the erosion resistance slightly varies with the Si content in this range, the Si content can be altered to change the color of TiSiN between orange and violet. With a color suitable for visual inspection of the covering member for erosion, the maintenance or replacement scheduling can be easily determined.

Advantageous Effects of the Invention

A covering member for preventing erosion according to the present invention described above in detail has a high erosion resistance, is resistant to repeated thermal shocks so as to have a long life, and has a particular color that allows the visual inspection of the surface layer for degradation.

DESCRIPTION OF EMBODIMENTS

Figure 1:
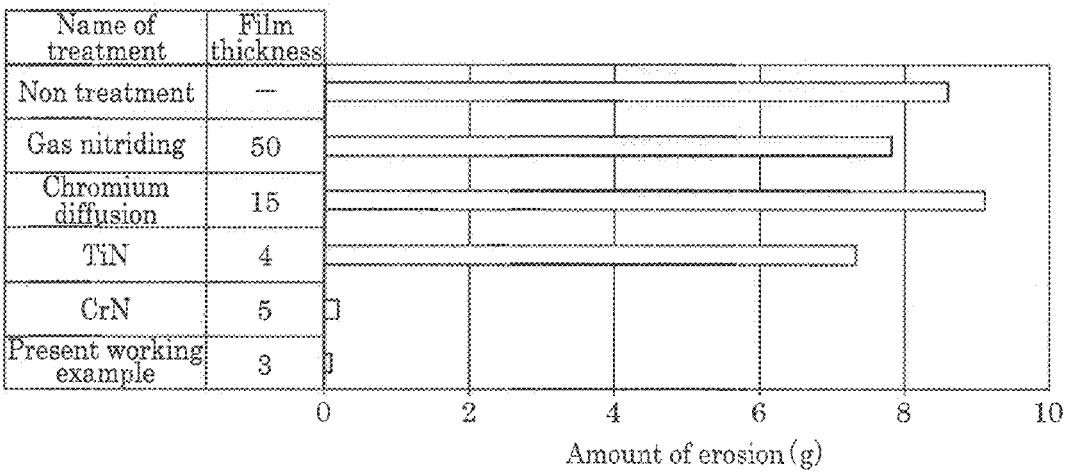
FIG. 1 is a graph showing the experimental results for the examples of the present invention and comparative examples.
Figure 2:
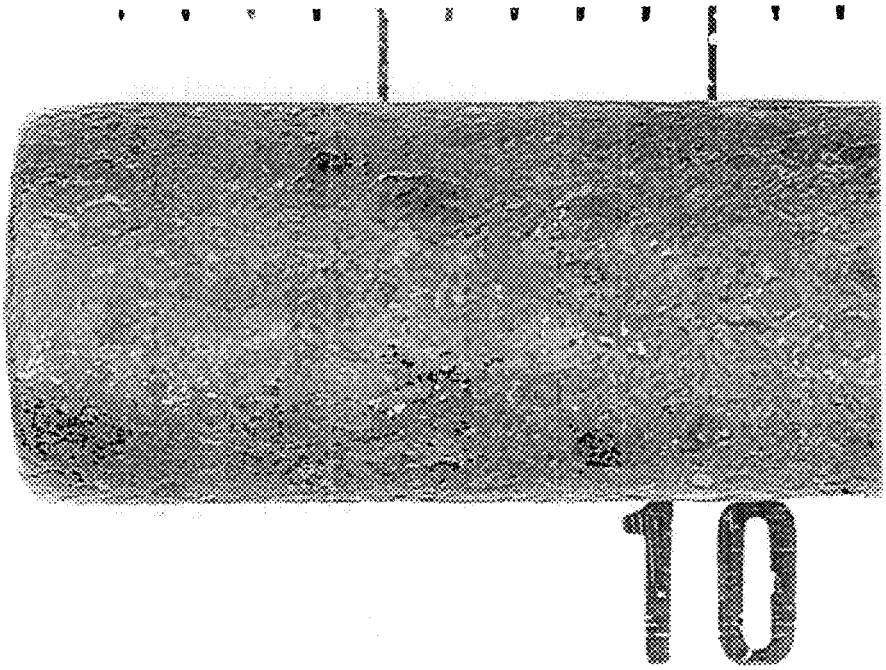
FIG. 2 is a color photomicrograph substituted for drawing showing the results of treatment in Example 2 for a surface-untreated specimen (a comparative example) shown in Table 2 (each graduation on the photomicrograph indicates 1 mm).
Figure 3:
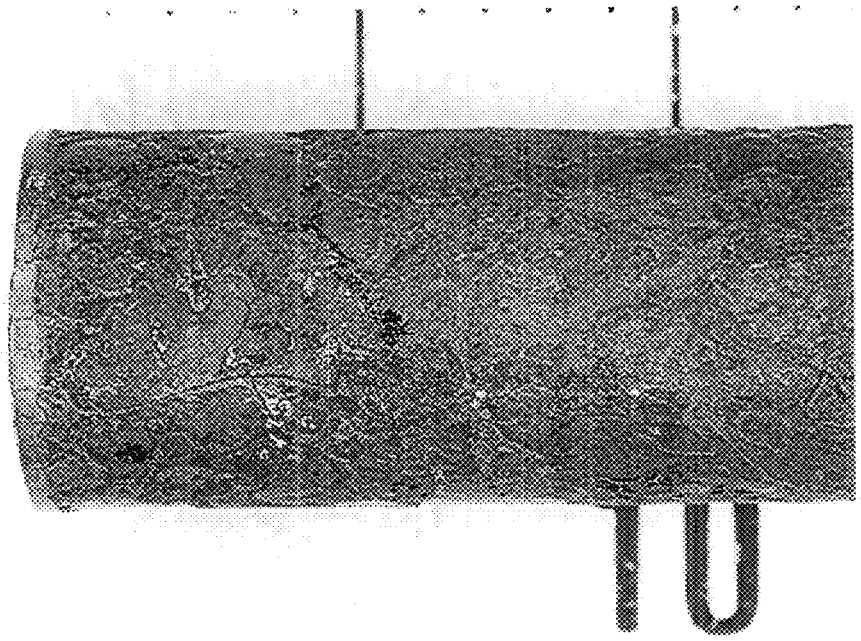
FIG. 3 is a color photomicrograph substituted for drawing showing the results of treatment in Example 2 for a nitrided specimen (a comparative example) shown in Table 2.
Figure 4:
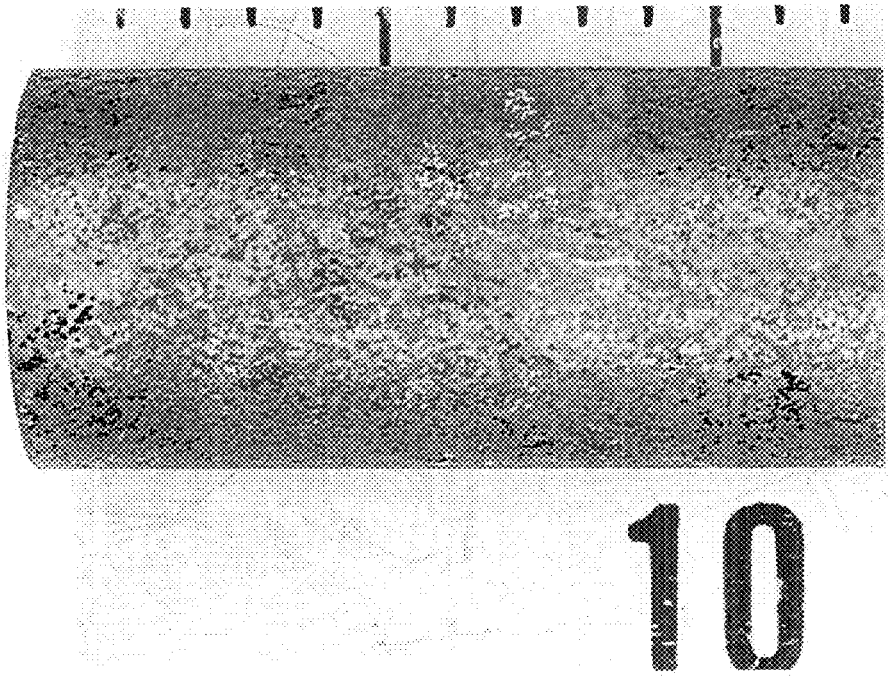
FIG. 4 is a color photomicrograph substituted for drawing showing the results of treatment in Example 2 for a chromized specimen (a comparative example) shown in Table 2.
Figure 5:
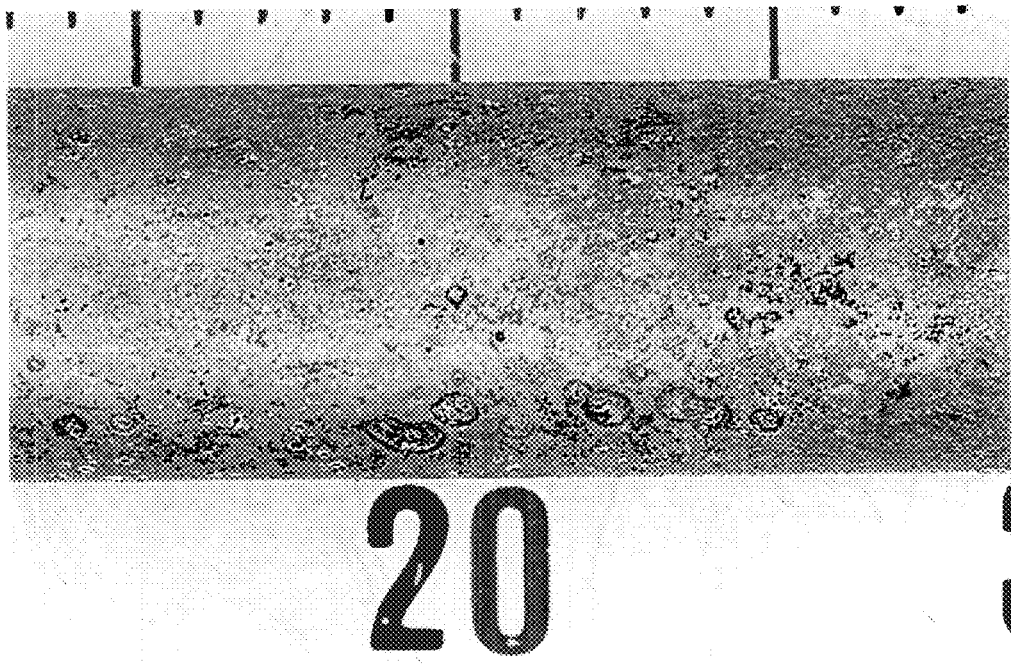
FIG. 5 is a color photomicrograph substituted for drawing showing the results of treatment in Example 2 for a TiN-coated specimen (a comparative example) shown in Table 2.
Figure 6:
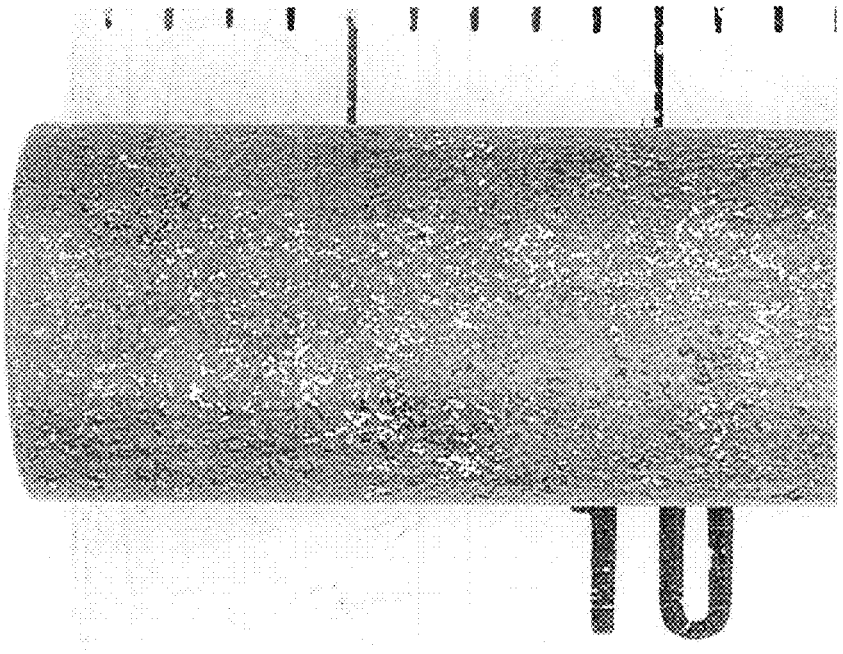
FIG. 6 is a color photomicrograph substituted for drawing showing the results of treatment in Example 2 for a CrN-coated specimen (a comparative example) shown in Table 2.
Figure 7:
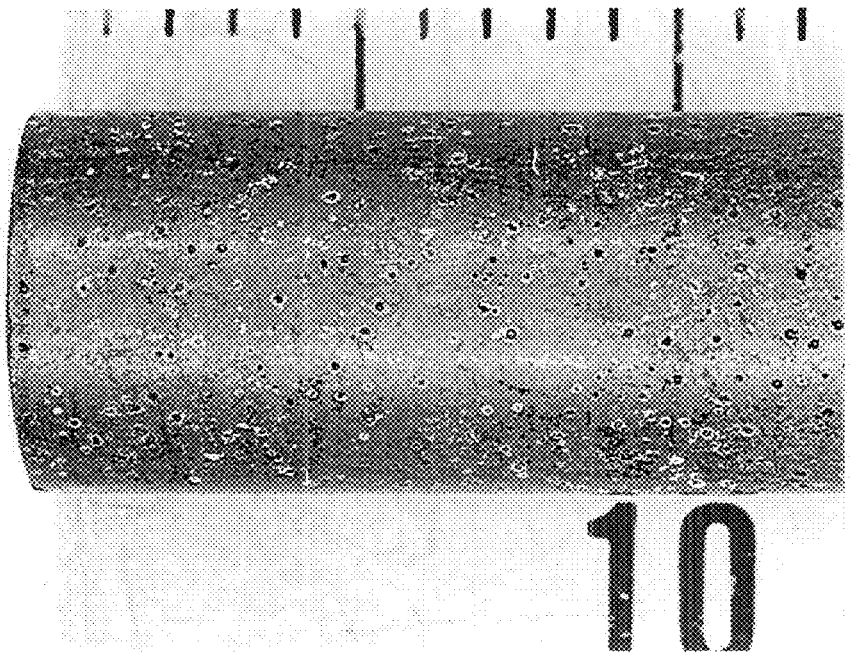
FIG. 7 is a color photomicrograph substituted for drawing showing the results of treatment in Example 2 for a specimen (a comparative example) having a TiSiN film (20%) as an upper layer and a TiAlN film as a lower layer shown in Table 2.
Figure 8:
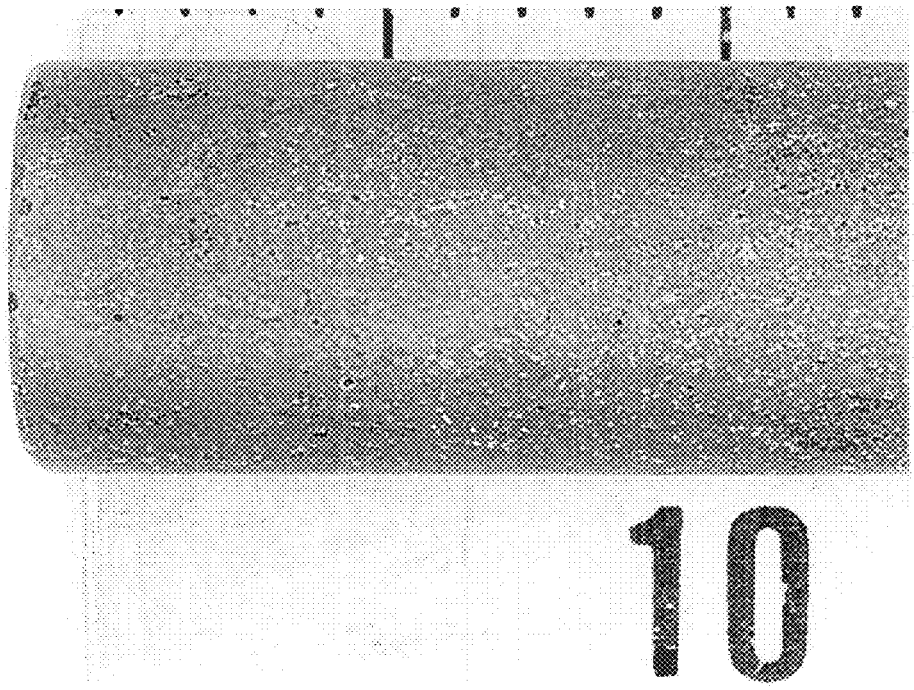
FIG. 8 is a color photomicrograph substituted for drawing showing the results of treatment in Example 2 for an example of the present invention shown in Table 2.

In accordance with a covering member for preventing erosion according to the present invention, a member that is eroded by contact with molten aluminum is coated with a ceramic material to prevent erosion. Examples of the member that will be eroded include die-casting components, including die-casting molds, to be in contact with molten aluminum, mechanical components, and cutting tools and other tools. The substrate to be coated is generally made of an iron material, including stainless or hot-work die steel serving as a die-casting component, a titanium material, or a superhard material. The coating of the substrate with the covering member can provide a high erosion resistance, resistance to repeated thermal shocks, and a particular color that allows the visual inspection of the surface layer for degradation.

As shown in Table 1, a covering member for preventing erosion coated on the substrate includes a Cr metal film as the lowest layer, a CrN film as the b layer, the intermediate layer, and a top TiSiN film as the a layer stacked in this order. Each of the layers other than the intermediate layer is a monolayer. The intermediate layer includes layered films composed of the TiSiN films of the a layer and the CrN films of the b layer alternately stacked on top of one another such that films of the same type do not overlap. The intermediate layer includes two or more and 270 (thickness approximately 2 μm) or less films in total. The thickness of the multilayer film including the lowest layer, the intermediate layer, the a layer (thickness 1 to 1.5 μm), and the b layer (thickness approximately 1 μm) generally ranges from 2 to 10 μm, preferably 2.5 to 3.5 μm. A smaller thickness of the multilayer film results in a lower erosion resistance. A larger thickness of the multilayer film results in a higher tendency for the covering member to be detached by a large thermal shock. The Cr metal film of the lowest layer, which serves as an adhesive between the substrate and the b layer, appropriately has a thickness of 1 μm or less.

TABLE 1

| | Film type | Blend ratio | Total number of layers |
|---|---|---|---|
| a layer | TiSiN | Ti 70% to 80%<br>Si 30% to 20% | One |
| Intermediate layer | TiSiN/CrN | Ti 70% to 80%<br>Si 30% to 20%<br>Cr 100% | Two or more |
| b layer | CrN | Cr 100% | One |
| Lowest layer | Cr | Cr 100% | One |

The blend ratio shown in Table 1 only considers the metal components.

The metal components of the TiSiN film of the a layer may have a Ti:Si ratio in the range of 90:10 to 50:50 (% by atom), preferably 70:30 to 80:20 (% by atom) in terms of erosion resistance and productivity. Within these ranges, the TiSiN film was found to have a high erosion resistance. The blend ratio can be altered within these ranges to change the surface color between orange and violet. With a color suitable for visual inspection of the covering member for erosion, the maintenance or replacement scheduling can be easily determined. The Cr metal film disposed between the substrate and the b layer of the CrN film to diffuse Cr ions in the substrate can also effectively function to improve the adhesion to the CrN film of the b layer.

These films are not necessarily formed by the PVD method or the P-CVD method.

The experimental results for the examples and comparative examples of the present invention are described below.

Example 1

A coated pin made of hot-work die steel (JIS SKD61 material) having a diameter of 6 mm and a length of 150 mm was used as the substrate. The coated pin was coated with a covering member shown in Table 1 by an ion plating method to prepare a test specimen according to the present example (the Ti:Si ratio of the TiSiN film in the a layer and the intermediate layer was 70:30 (% by atom), and the total number of sublayers of the intermediate layer was 90). Test specimens according to comparative examples were prepared by the surface treatments of the coated pin shown in FIG. 1.

Approximately a half-length of each of the test specimens according to the example and the comparative examples was immersed in molten aluminum (JIS ADC12) in a crucible at 670° C. for 25 hours. The erosion resistance was determined from the change in weight due to the immersion. The graph of FIG. 1 shows the results.

The results show that the test specimen covered with the CrN film according to one of the comparative examples, which had a metallic color that makes visual inspection for degradation difficult, also exhibited a high erosion resistance. It was proved that the test specimen according to the present example was a covering member having a high erosion resistance and a color that allows the visual inspection for degradation. To be on the safe side, the total number of sublayers of the intermediate layer in the test specimen according to the present example was 90. It was, however, assumed that even a two-sublayer intermediate layer had a gradient function, albeit an incomplete one, for hardness. Thus, it was separately confirmed that the two-sublayer intermediate layer could prevent breakage by thermal shock.

Example 2

The substrate was the same coated pin as in Example 1. After the substrate was subjected to the diffusion and deposition treatments listed in "Name of Surface treatment" of Table 2, the substrate was immersed in molten aluminum (ADC12) in a crucible at 650° C. for 90 seconds and then cooling water at 25° C. for one second. After the immersion was repeated 2000 times, breakage, cracking, and erosion by thermal shock were checked. The color photomicrographs of FIGS. 2 to 8 show the state of breakage and erosion by thermal shock. Table 2 shows the results observed.

TABLE 2

| Name of surface treatment | Film thickness μm ( ) Diffusion layer | Erosion % | State of surface degradation |
|---|---|---|---|
| Non-treatment | — | 100 | Severe erosion on the entire surface |
| Nitriding | (50) | 25 | Severe erosion on the entire surface |
| Chromizing | (20) | 1.5 | Partly severe erosion |
| TiN | 3 | 0.5 or less | Erosion proceeds because of insufficient erosion resistance |
| CrN | 3 | 0.5 or less | A small number of cracks; little erosion; difficult to see degradation |
| Upper Layer: TiSiN(20%) + Lower Layer: TiAlN | 3 | 0.5 or less | Hard film with innumerable small cracks; erosion from cracks |
| Present working example | 3 | 0.5 or less | No crack or erosion |

The erosion percentage in the table represents the change in weight resulting from the experiment, wherein the erosion percentage for untreated specimens was 100. Erosion percentages of 0.5% or less could not be correctly determined and are generally indicated as 0.5% or less.

The invention claimed is:

1. A covering member for preventing erosion to be applied to a substrate that will be eroded by contact with molten aluminum, comprising:

a lowest layer, a b layer, an intermediate layer, and an a layer to be stacked in this order on the substrate, wherein the lowest layer is a Cr metal film, the b layer is a CrN film, and the top a layer is a TiSiN film, and the intermediate layer includes layered films composed of the TiSiN films of the a layer which is an outermost layer and the CrN film of the b layer alternately stacked on top of one another such that films of the same type do not overlay.

2. The covering member for preventing erosion according to claim 1, wherein the substrate is made of an iron material, including stainless, a titanium material, or a superhard material.

3. The covering member for preventing erosion according to claim 1, wherein each of the films is formed by a physical vapor deposition method or a plasma chemical vapor deposition method.

4. The covering member for preventing erosion according to claim 1, wherein the metal components of the TiSiN film of the a layer has a Ti:Si ratio in the range of 90:10 to 50:50 (% by atom).

5. The covering member for preventing erosion according to claim 1, wherein the intermediate layer includes two or more alternately stacked a layer and b layer in total, and each of the lowest layer, the b layer, and the a layer of the outermost layer is a monolayer.

6. The covering member for preventing erosion according to claim 1, wherein the thickness of the intermediate layer and the a and b layers layered on both sides of the intermediate layer ranges from 2 to 10 μm.

7. The covering member for preventing erosion according to claim 5, wherein the thickness of the intermediate layer and the a and b layers layered on both sides of the intermediate layer ranges from 2 to 10 μm.

* * * * *